US007204372B2

(12) United States Patent
Kin et al.

(10) Patent No.: US 7,204,372 B2
(45) Date of Patent: Apr. 17, 2007

(54) RUG DISPLAY SYSTEM

(75) Inventors: Christopher A. Kin, Hamilton, OH (US); Henry R. Kin, Cincinnati, OH (US)

(73) Assignee: Kin Products, Inc., West Chester, OH (US)

( * ) Notice: Subject to any disclaimer, the term of this patent is extended or adjusted under 35 U.S.C. 154(b) by 255 days.

(21) Appl. No.: 10/744,289

(22) Filed: Dec. 23, 2003

(65) Prior Publication Data

US 2004/0134867 A1 Jul. 15, 2004

Related U.S. Application Data

(63) Continuation-in-part of application No. 10/269,585, filed on Oct. 11, 2002, now Pat. No. 6,981,596.

(51) Int. Cl.
*A47F 7/16* (2006.01)

(52) U.S. Cl. ..... 211/45

(58) Field of Classification Search ..... 211/45, 211/46, 89.01, 124, 105.1; 223/91, 93, 96; 24/3.12, 536

See application file for complete search history.

(56) References Cited

U.S. PATENT DOCUMENTS

| | | | | |
|---|---|---|---|---|
| 888,172 | A | 5/1908 | Judd | |
| 916,496 | A | 3/1909 | Shindlebower | |
| 979,755 | A | 12/1910 | Franklin | |
| 1,688,255 | A | 10/1928 | Wasch | |
| 2,000,336 | A | 5/1935 | Kerr | |
| D134,111 | S | 10/1942 | Bersin et al. | |
| 2,622,300 | A * | 12/1952 | Marziani | 24/501 |
| 2,946,454 | A | 7/1960 | Asher | |
| 3,187,900 | A | 6/1965 | Schneider | |
| 3,194,405 | A * | 7/1965 | Hawie | 211/89.01 |
| 3,207,318 | A | 9/1965 | Gilbert | |
| 3,235,093 | A | 2/1966 | Eisbart et al. | |
| 3,315,813 | A | 4/1967 | Schneider | |
| 3,330,418 | A | 7/1967 | Schneider | |
| 3,603,461 | A | 9/1971 | Best | |
| 3,759,398 | A | 9/1973 | Romney | |
| 4,049,125 | A | 9/1977 | Rochestie | |
| 4,073,383 | A | 2/1978 | Rummer | |
| 4,305,510 | A | 12/1981 | Eppy | |
| 4,427,118 | A | 1/1984 | Corrigan et al. | |
| 4,767,002 | A | 8/1988 | Malcolm | |
| 5,318,174 | A * | 6/1994 | Zoroufy | 211/45 |
| 5,452,809 | A | 9/1995 | Capel | |
| 5,649,631 | A | 7/1997 | Loflin | |
| 5,979,662 | A | 11/1999 | Green | |
| 6,237,782 | B1 | 5/2001 | Hunn | |
| 6,340,092 | B1 | 1/2002 | McGrath, Jr. | |

(Continued)

*Primary Examiner*—Sarah Purol
(74) *Attorney, Agent, or Firm*—Dinsmore & Shohl LLP

(57) ABSTRACT

A rug display system includes a base having a plurality of upwardly extending posts and a frame comprising a front, top and rear section. At least a portion of the frame is configured to be rotatably mounted on a post of the base. The rug display system can further include a front support member attached to the frame adjacent to the front section and configured to movably support the frame on a display surface in use. A rug clip for use in a rug display system includes a gripping member having oppositely disposed gripping elements and a biasing member mounted over at least a portion of the gripping member and having a first and second top leg.

9 Claims, 11 Drawing Sheets

U.S. PATENT DOCUMENTS 6,394,291 B2 5/2002 Maier-Hunke
6,547,087 B2 4/2003 Accatino
6,668,432 B2 * 12/2003 Lewis ..... 24/536
6,691,878 B1 2/2004 Ouitz
2002/0047079 A1 4/2002 Gerson

* cited by examiner

RUG DISPLAY SYSTEM

CROSS-REFERENCES TO RELATED APPLICATIONS

This continuation-in-part application claims the benefit of U.S. Non-Provisional application Ser. No. 10/269,585, filed Oct. 11, 2002 now U.S. Pat. No. 6,981,596.

FIELD OF THE INVENTION

The invention relates to systems for displaying rugs, and more particularly to rug display systems comprising a plurality of frames rotatably supported on a display surface for enabling convenient and full view display of products.

BACKGROUND OF THE INVENTION

The typical consumer of rugs desires to view the entire rug prior to purchase. With larger sizes of area rugs, display and access to full view inspection is often space prohibitive. Rugs may be displayed on a surface stacked on one another. However, due to the size and weight of most rugs, the rugs are often difficult to maneuver, and thus, do not allow the consumer to conveniently obtain a complete view of the front and back sides of the rug.

Heretofore, it has been known to display rugs with hanging assemblies, wherein the rugs are supported in hanging relation by a plurality of rotatable rug hangers and movable toward and away from each other so as to allow a consumer to obtain a view of the rug. More particularly, it has been known to display rugs with a cantilevered pivot type system known as the "swing arm." The swing arm includes a fabricated bar generally extending the width of the rug and is welded to a pivot high above the display floor. The rug is secured to the fabricated bar by clamp-style clips so that the rug can hang down toward the floor. The fabricated bars are themselves generally pivoted from a relatively large outboard structure mounted to the floor and having base members extending in various directions adjacent to the floor to provide stability to an overall structure having much of its movement, weight and stress near the top, high above the floor. In order to view each rug displayed by such a swing arm system, the customer tugs on the rug, thereby pivoting the fabricated bar and rug in one direction to view the next rug in the display.

The present invention recognizes and addresses some of the problems with such swing arm systems. First, the present invention recognizes that the swing arm systems are very large and inherently unstable. The weight of the fabricated bars holding the rugs high above the floor requires a relatively large and obtrusive superstructure and base, naturally increasing the size, cost, assembly and space requirements for such structures. Accordingly, there is a desire for improved rug display systems supported on a display surface while utilizing a minimum amount of floor space required.

Second, the present invention recognizes that it is difficult to attach and detach rugs to the swing arm system as the fabricated bar from which the rugs hang in swing arm systems is located a substantial distance above the floor. Moreover, the fabricated bar is generally not removable from the outboard structure to allow a clerk to mount the rug to the fabricated bar while on the floor. Thus, more than one clerk is often needed to balance and raise the rug while securing the rug to the fabricated bar high above the floor. Accordingly, there is a desire for rug display systems providing a configuration so that a rug can be more easily and conveniently secured to or removed from the rug display systems.

Also, the present invention recognizes that swing arm systems can allow and even cause damage to the rugs displayed from the systems due, in part, to the method of operation and display provided by the swing arm system. For example, consumers wishing to view a rug displayed from swing arm systems are required to pull on the bottom of the hanging rug in order to rotate the swing arm to see the next rug in the display rack. This tugging action puts undue stresses on the rug and the attachment clamps holding the rug to the swing arm. Such stress can result in the rug being removed from the swing arm and/or damaged as the clamps dig into the rug or the rug is essentially ripped away from the clamps on the fabricated bar. In addition, as the swing arm system does not provide an easily accessible surface to display pertinent sales information concerning the rug, vendors must pin or tag (e.g., by piercing) the pertinent sales information to the back of the rug. Often, information pinned to the rug can fall off. Moreover, pinning or tagging can damage the rug and/or be ripped off of the rug in use. Accordingly, there is a desire for rug display systems that can display rugs and pertinent advertising information conveniently and without damaging the rugs.

In addition, as mentioned, the outboard structure of swing arm systems is generally very large making it difficult (physically and technically) to assemble, disassemble and ship. Quite often, swing arm systems require skilled construction crews and special equipment to deliver and assemble the systems. Accordingly, there is a desire for rug display systems with a minimal base structure capable of being easily assembled, disassembled and shipped.

SUMMARY OF THE INVENTION

Accordingly, the present invention is intended to address and obviate problems and shortcomings and otherwise improve previous rug display systems. More particularly, it is one object of the present invention to provide rug display systems comprising a plurality of frames supported on a display surface which provides improved and full view access to displayed rugs.

To achieve the foregoing and other objects and in accordance with the exemplary embodiments of the present invention, rug display systems herein comprise a base having a plurality of upwardly extending posts and a frame comprising a front, top and rear section. At least a portion of the frame is configured to be rotatably mounted on one of the posts, and a front support member is attached to the frame adjacent the front section and configured to movably support the frame on a display surface in use.

To still further achieve the foregoing and other objects of the present invention, improved rug clips for use in the rug display system comprise a channel-shaped bracket including a top leg, a bottom leg, and a connecting member. The connecting member biases the top leg toward the bottom leg.

To further achieve the foregoing and other objects of the present invention, improved rug clips for use in the rug display system may also comprise a gripping member having oppositely disposed gripping elements and a biasing member having a first and second top leg. The biasing member may be mounted over at least a portion of the gripping member such that one of the first and second top legs is each biased toward a different one of the oppositely disposed gripping elements.

To yet further achieve the foregoing and other objects in accordance with other exemplary embodiments of the present invention, a packaging system for shipping a plurality of rug display system frames comprises a crate having a frame cradle positioned along the upper and lower proximate and distal horizontal edges of the crate. A plurality of spaced recesses is formed in each cradle. Corresponding recesses of the frame cradles are positioned on the upper and lower horizontal edges of the crate in a predetermined alignment to receive and maintain the plurality of frames within the crate in a predetermined spaced orientation relative to one another.

To even further achieve the foregoing and other objects in accordance with additional exemplary embodiments of the present invention, a packaging system for shipping an at least partially assembled rug display system having a base and a plurality of frames rotatably mounted on the base, comprises a front section assembly. The front section assembly includes a first securing member positioned on top of the bottom sections of the rug display frames adjacent the front sections and a second securing member positioned below the bottom sections of the frames. The bottom sections of the frames are secured between the first and second securing members. The packaging system further comprises a rear section securing member positioned to secure the base to at least one of the frames for transportation as a unit.

Still other embodiments, combinations, advantages and objects of the present invention will become apparent to those skilled in the art from the following descriptions wherein there are shown and described alternative exemplary embodiments of this invention for illustration purposes. As will be realized, the invention is capable of other different aspects, objects and the embodiments all without departing from the scope of the invention. Accordingly, the drawings, objects, and description should be regarded as illustrative and exemplary in nature only and not as restrictive.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF EXEMPLARY EMBODIMENTS

Figure 1:
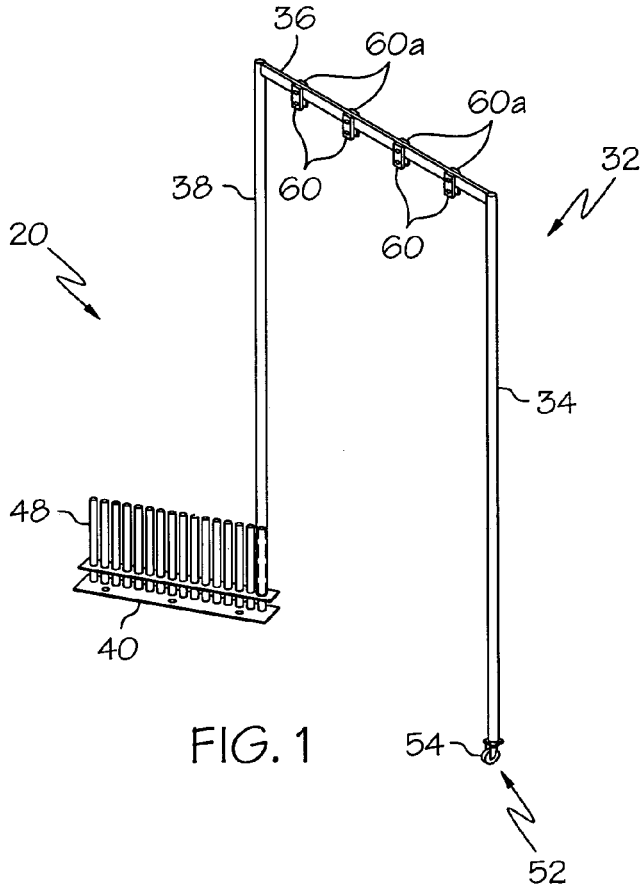
FIG. 1 is a front perspective view of an exemplary rug display system according to the present invention with all but one of the frames omitted for the purpose of clarity, and illustrating a frame mounted to a base.

Referring to the drawing figures in detail, wherein like numerals indicate the same elements throughout the drawing figures, FIG. 1 illustrates a rug display system 20 with a single frame 32 mounted to a base 40. In this example, the frame 32 is generally rectangular in shape and comprises a top section 36 connected to a front section 34 and a rear section 38. In another embodiment, the frame 32 might be configured in any variety of shapes including, but not limited to a square. The frame 32 may be sized according to the size of the rugs intended to be displayed. Any shape which can be pivoted on a base 40 and supported with a front support member 52 (e.g., wheel 54), can be provided as appropriate. For example, the frame may be sized approximately 9'×12' to display full size rugs, or approximately 6'×9' or 5'×8' to display basic rugs, approximately 4'×6' to display throw rugs, 2'×4' to display scatter rugs and/or 2'×8' to display runner rugs.

Moreover, as a result of the spaced relationship between adjacently mounted frames, a rug can be mounted to a frame narrower than the rug with the excess width of the rug fitting between the rear sections of adjacent frames between adjacent posts 48. As will be understood, the pivoting of adjacent frames on spaced posts 48 explained further below allows portions of supported rugs to extend rearwardly through gaps between adjacent posts without interference in use. This facilitates even more leeway to the retailer on rug size variations, and simplifies rug display and system maintenance. Furthermore, the frames 32 may comprise a plurality of shapes to display round, oval or odd shaped rugs as well. As the rear section (e.g., 38) of a frame 32 may be configured to mount to a post 48 of a base 40 regardless of the shape or size of the frame, it is possible to provide a rug display system 20 with a plurality of frames 32 in a variety of shapes and sizes.

As further described below, the frame 32 can be advantageously provided in the form of a unified structure comprising various pieces of steel tubing and steel posts welded or otherwise secured together. For example, if desired, the frame 32 may be constructed of various pieces of steel, plastic, aluminum, composite or other sturdy tubing and posts fastened together by any conventional fastening means so that the display system 20 can be broken down for transportation or storage.

In one embodiment, the front section 34 and rear section 38 might be provided in the form of 18 gauge powder coated steel tubing. In addition, the top section 36 might be comprised of 11 gauge powder coated steel post. In another embodiment, the front section 34, top section 36 and rear section 38 may be comprised of any combination of posts and/or tubing constructed from any combination of steel, plastic, composite, aluminum and/or any other appropriately strong and durable substance.

In FIG. 1, the front section 34 of the exemplary frame 32 is shown as including a front support member 52 positioned adjacent the bottom portion of the front section 34. In another embodiment, a bottom section (e.g., see section 131 of FIG. 4) may be mounted between the rear section 38 and the front section 34 and provide for attachment of the front support member 52 thereto. Other cross-members or supports could also be provided to frame 32 to augment its rigidity and strength as deemed appropriate.

In the examples illustrated, the front support member 52 comprises a front support member roller or wheel 54, an axle (see axle 140 in FIG. 5) and bracket assembly (not shown) for mounting the front support member arrangement adjacent to the front section 34 of the frame 32. This assembly could be provided as a relatively standard caster arrangement commonly available in the industry. In another embodiment, the front support member 52 may include a roller ball or other low friction moving support arrangement extending from the bottom of frame 32 and configured to moveably support the front section 34 of the frame 32 on a display surface. In still another embodiment, the front support member 52 may include a plastic (e.g., Teflon) or fiberglass body or other such friction minimizing interface affixed to the bottom of frame 32 (e.g., adjacent to the front section 34) and configured to moveably support the front section 34 of the frame 32 on a display surface. As an example, a front support member wheel 54 might be constructed of hard polyolefin in order to withstand wear from rigid surfaces. In another embodiment, the front support member 52 may be constructed from any material suited for support of the weight of the frame and displayed rugs and smooth rotation about a display surface.

Still referring to FIG. 1, the top section 36 of the exemplary frame 32 includes a first set of rug clips 60 mounted to the frame 32. As discussed later, the rug clips 60 are configured to secure a rug to the frame 32 of the rug display system 20. If desired, a second set of rug clips (e.g., 60*a*) can be mounted to the opposite side (back side) of the top section 38 so that rugs may be secured and displayed on the opposite side of the frame 32. As described later, the rug clips 60 and 60*a* may be mounted at any position along frame 32 depending on the size and shape of the rug and/or vendor preferences.

Figure 2:
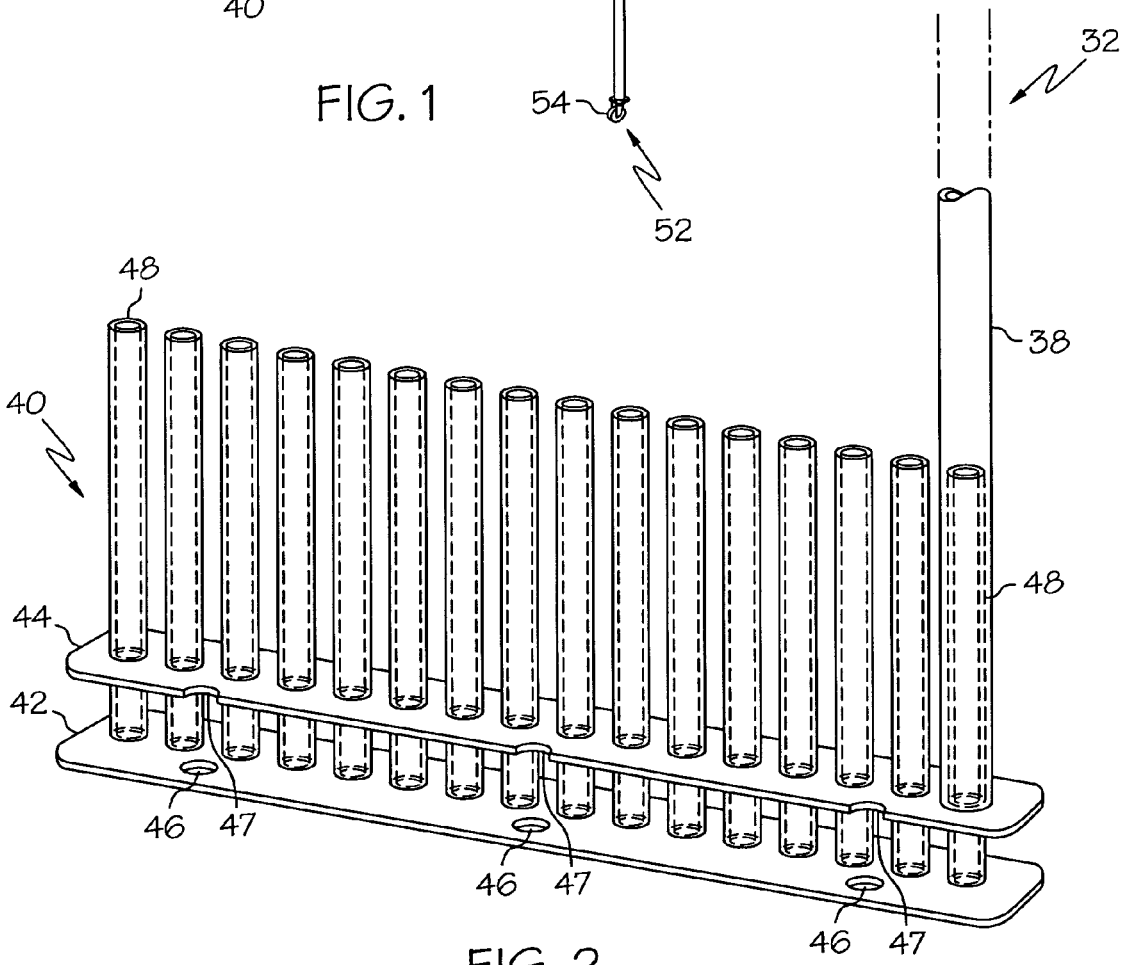
FIG. 2 is a close-up perspective view of an exemplary base of the present invention.

Referring more specifically to FIG. 2, an expanded view of an exemplary base 40 of FIG. 1 is illustrated. The rear section 38 of the frame 32 is to be mounted onto a post 48 extending upwardly from the base 40. In one embodiment, the base 40 comprises a lower base plate 42, an upper base plate 44 and a plurality of posts 48. The lower base plate 42 and upper base plate 44 might be generally elongated, flat sheets of steel. In one embodiment, the posts 48 might be welded to the lower base plate 42. The upper base plate 44 may include a plurality of apertures corresponding to the posts 48 that are welded to the lower base plate 42. The plurality of posts 48 engage the plurality of apertures on the upper base plate 44 thereby allowing the upper base plate 44 to be positioned in a spaced relationship to the lower base plate 42. In one embodiment, the upper base plate 44 might be positioned approximately 2" from the lower base plate 42 leaving about 16" of post 48 above the upper base plate 44 for mounting of a frame 32 thereto Once the upper base plate 44 is at its desired position, it is then welded to the plurality of posts 48. While upper base plate 44 may be optional, it can advantageously help keep the adjacent posts 48 straight and appropriately spaced, can add to the strength and rigidity of base 40 and posts 48, and can facilitate fabrication (e.g., welding) of the posts 48 onto base plate 42. For example, it might be preferred to weld the posts 48 to base plates 42 and 44 in the space between the plates so that the bottom of plate 42 (which will face the display surface or floor) and the top of plate 44 (which will be closest to the rotating parts of frame 32) can be kept smooth and clear of weld spatter and the like.

In one exemplary embodiment, posts 48 might be configured so that a frame 32 can be rotatably mounted on any one of such posts, as desired. For example, rear section 38 can be provided in the form of a tube, or otherwise comprise a substantially hollow portion at its lower end. The inner diameter of the hollow portion of rear section 38 might correspond with and be slightly greater than the outer diameter of the posts 48 of the base 40. The difference between the inner diameter of the frame 32 and the outer diameter of the posts 48 might be such that the friction between the rear section 38 of the frame 32 and the posts 48 is minimized to allow the frame 32 to be supported by and rotated about the posts 48 without much effort. For example, the inner diameter of the rear section 38 of the frame may be 1½ in., whereas the outer diameter of the post 48 may be 1¼ in. Thus, in such embodiment, the rear section 38 of the frame 32 can rotatably fit over the post 48 of the base 40.

Grease or another conventional lubricant may be placed either on the posts 48 or within the bottom portion of the rear section 38 of the frame 32 in order to achieve desired friction between the rear section 38 of the frame 32 and the posts 48. In another embodiment, any arrangement of bushings/ball bearings might be effectively located adjacent the interface of the rear section 38 of the frame 32 and the post 48 to facilitate desired rotation of the frame 32 relative to the post 48.

The upper base plate 44 also provides a resting or support surface on base 40 for the frame 32. In addition, the upper base plate 44 adds strength to the base 40 as the posts 48 are rigidified with each other and base plates 42 and 44, and spacing and upright orientation of posts 48 is further rigidly fixed. As previously stated, in one embodiment, the distance between the lower base plate 42 and the upper base plate 44 in an exemplary rug display arrangement might be approximately 2", but could be easily adapted according to a desired application, post sizing and spacing, weight of articles to be displayed, materials used, and other variables. For example, the height of upper base plate 44 can advantageously correspond the pivot height of rear section 38 on base 40 with the height of front support member 52 (e.g., a caster wheel or other movable support arrangement). If the upper base plate 44 is absent, more attention to clean attachment of posts 48 to plate 42 might be required, as the pivot support surface would be plate 42. In another embodiment, additional upper base plates 44 can be added to further strengthen the base 40.

Still referring to FIG. 2, the lower base plate 42 may include a plurality of apertures 46 configured to accept a fastener for securing the base 40 to a horizontal display surface (e.g., a concrete floor). The base 40 may be secured to a horizontal display surface by any conventional screw or bolt, including, but not limited to, lag screws, anchor bolts or power driven fasteners. Access to the apertures 46 of the lower base plate 42 with a drill, tools or fasteners may be made more convenient by providing access cutouts 47. The cutouts 47 may comprise a semi-circle cut into a portion of the upper base plate 44 and may be positioned over and slightly larger than the apertures 46 in the lower base plate 42. While the base 40 in the exemplary embodiment of FIG. 6 can be secured to a display surface, it is understood that the base 40 may stand alone on a surface without being secured to the display surface. Such an arrangement might be desired where the display is to be mobile or otherwise easily moveable within a display area.

The embodiment of FIG. 2 illustrates an elongated base 40 with sixteen posts 48 arranged in a line extending the length of the lower base plate 42 and upper base plate 44. It is possible that the layout of the display surface may require a rug display system 20 configured to fit within certain space requirements. Accordingly, in another embodiment, the base may comprise more or less than sixteen vertically extending posts 48, and therefore, have more or less than sixteen frames 32. In addition, as discussed later, the base 40 may comprise two rows of posts 48 arranged in two lines extending the length of the base 40 so that a number of accessories may be mounted to the base 40. The posts of such two row embodiments may be staggered or aligned, and/or may have variable spacings relative to adjacent posts, as desired. Moreover, the arrangement of posts 48 on base plate 42 need not be in a straight line, as arcuate or angular arrangement may be desired for some applications. Also, the base may comprise a variety of shapes including, but not limited to linear, a semi-circle, a full circle, an L-shape, a 45° angle, etc. Such arrangements can be achieved by manipulating the shapes of the lower and upper base plates 42 and 44. In addition, the appearance of the rug display system 20 may be manipulated by welding the plurality of posts 48 to the lower base plate 42 in a staggered arrangement and providing an appropriate upper base plate 44 accordingly.

Also, it should be understood that while FIG. 2 illustrates a single exemplary base, a plurality of bases may be locked, welded or otherwise connected together (e.g. FIG. 3), either temporarily or permanently, to form a unified base capable of supporting any number of frames 32 in a variety of arrangements. Because the system of the present invention is also modular in nature, it is contemplated that frames can be used on various bases, bases can be easily arranged in a display layout (e.g., substantially straight line, U-shaped, L-shaped, circular, etc.), and the setup and function of the frames and bases can be mixed and matched to accommodate a wide variety of display needs.

Figure 3:
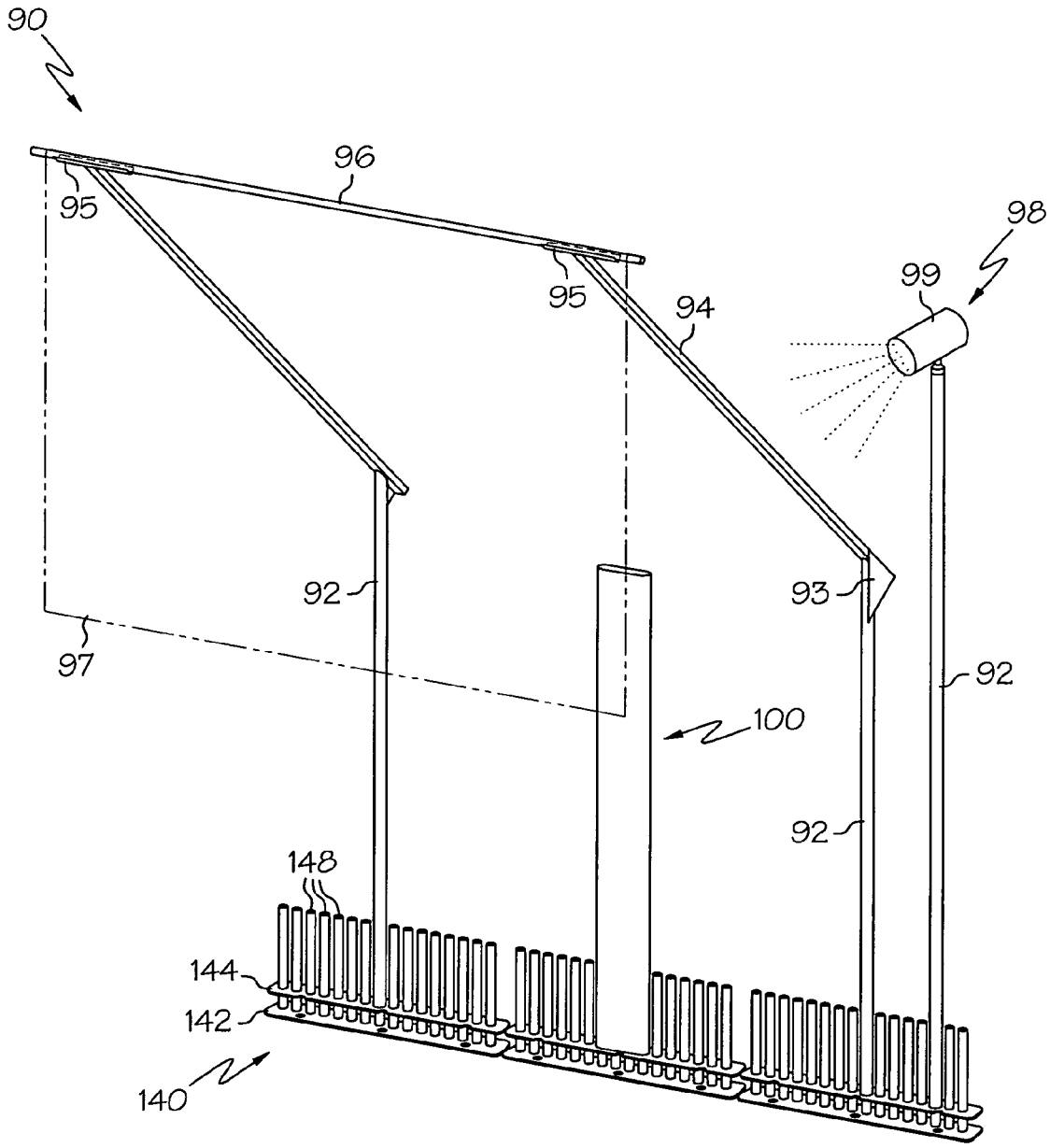
FIG. 3 is a front perspective view of a partially assembled (i.e., no rug frames shown) exemplary rug display system according to the present invention illustrating multiple accessories contemplated by the present invention.

Another feature of the present invention is that a variety of accessories can also be selectively mounted to the base 40 of the rug display system. Referring to FIG. 3, for example, three exemplary accessories, namely an accessory display assembly 90, a light pole 98 and a spacer or divider 100, are shown mounted to a base 140. The base 140 in this example might be comprised of forty-eight posts 148 arranged in a line extending the length of the base 140. However, as previously discussed, the base 140 may comprise a variety of shapes and sizes. In addition, the base 140 may comprise two rows with any number posts 148 arranged in two lines extending the length of the base 140, wherein one row may be used for mounting frames and the other row may be used for mounting accessories.

An example of an accessory display assembly 90 is shown as including two vertically extending poles 92, two extension arms 94 and a mounting bar 96. Alternatively, and discussed, the accessory display assembly may be comprised simply of a single pole 92 with one or more of a plurality of accessories secured thereto. Each pole 92 can be mounted to a post 148 of the base 140 in the same manner as the rear section of the frame described above. Poles 92 might be provided, for example, in the form of 18 gauge powder coated steel tubing or any other appropriately strong and durable materials. The poles 92 may extend upwardly from the base 140 any length including, but not limited to, the height of the rear section of a frame, depending on the application and the particular function of the desired accessories.

The extension arms 94 may similarly be comprised of powder coated steel tube and post, or any other appropriately strong and durable substance. The tube and post may be secured together by welding or otherwise securely fastening the tube and post to a steel plate 93 configured to set the steel post at about a 135° angle relative to the steel tube. The tubular portion of the extension arm 94 may be sized with a smaller diameter than the diameter of the pole 92 so that each extension arm 94 can be telescopingly mounted to a pole 92 by inserting the tubular portion of the extension arm 94 into the upper end of the pole 92, such as in an overlapping friction fit arrangement know as a "swedge". The post portion of the extension arm 94 may comprise a bracket 95 welded to the distal end of the post and sized and shaped for securing a mounting bar 96 thereto. The mounting bar 96 may be comprised of powder steel coated steel tubing and may be secured to the bracket 95 of the tube portion of the extension arm 94 by any conventional fasting means including, but not limited to metal screws.

Mounting bar 96 can be utilized to support any number of accessories including, for example, lights, banners, speakers and video/security cameras. FIG. 3 illustrates an example where banner 97 is mounted to the mounting bar 96 of the accessory display assembly by sliding the mounting bar 96 through a pocket located on the rear of the banner 97, and then securing the ends of the mounting bar 96 to the brackets 95 of the extension arms 94. The banner 97 may be used to display decorations, pertinent advertising or sales information.

It is understood that the accessory display assembly 90 of the present invention may comprise any combination of tubes or posts comprised of steel, plastic, composite, aluminum and/or any other appropriately strong and durable substance. Moreover, while the accessory display assembly 90 illustrated in FIG. 3 may be comprised of modular components secured together, it is contemplated that the accessory display assembly 90 may similarly be comprised of any component(s) capable of mounting to a base of the present invention and displaying an accessory therefrom, including but not limited to a single pole.

For example, FIG. 3 illustrates a light pole 98 comprising a standard pole 92 (described above) mounted to the base 140 at its proximal end and including a light 99 secured adjacent to the opposite or distal end. The light 99 may be used to illuminate the rugs displayed by the rug display system, a banner on the mounting bar or the display area generally. In addition, any number of accessories may be secured directly to one pole 92 at any position along the pole 92 including, but not limited to a banner, speaker, security camera, etc. If desired, rotation of a single pole about the post 148 of the base 140 may be prevented by providing a plate with an aperture (not shown) welded or otherwise secured to the pole 92. It is envisioned that as the pole 92 is mounted to the post 48, such a plate might include a flange or other portion which mounts over the adjacent post 148 and slides down adjacent the upper base plate 144 or otherwise corresponds with a portion of an adjacent post 148. Therefore, the plate would function to substantially prevent the pole 92 from rotating about the post 148. Any number of arrangements could similarly be implemented to prevent substantial rotation, such as a set screw or friction fit.

FIG. 3 also illustrates a divider 100 positioned near the middle of the base 140. The divider 100 may be comprised of a generally U-shaped sheet of metal with two sleeves 101 (best seen in FIG. 11) located on backside of the metal adjacent the bottom of the divider 100. The two sleeves 101 slide over the base posts 148 to secure the divider 100 in upright position. It should be understood that the divider 100 may comprise a variety of shapes and sizes and may be secured to any number of base posts 148 by any conventional means. The divider 100 may be used to separate or space the rug display system into two or more viewing stations to enable more than one consumer to simultaneously view displayed rugs. Absent the divider 100, it may be difficult for two or more consumers to view rugs displayed on a single base section of the rug display system as the consumers might be shifting frames in competing directions. In addition, the divider 100 may be used to display pertinent advertising or sales information regarding the rugs displayed by the rug display system. As described above, due to the novel design of the present invention, the rug display system is widely adaptable, easily modified, and capable of displaying any combination of rugs and accessories therefrom.

As previously described, FIG. 1 illustrates an exemplary embodiment of a simple frame 32 structure in accordance with the present invention. However, frames for the rug display system of the present invention may be customized or otherwise adapted in accordance with vendor preferences. For example, frames may be sized or shaped according to the size and/or shape of rugs intended to be displayed. Moreover, the frames may optionally incorporate a number of features and accessories including, but not limited to those illustrated in the example of FIG. 4 discussed below.

Figure 4:
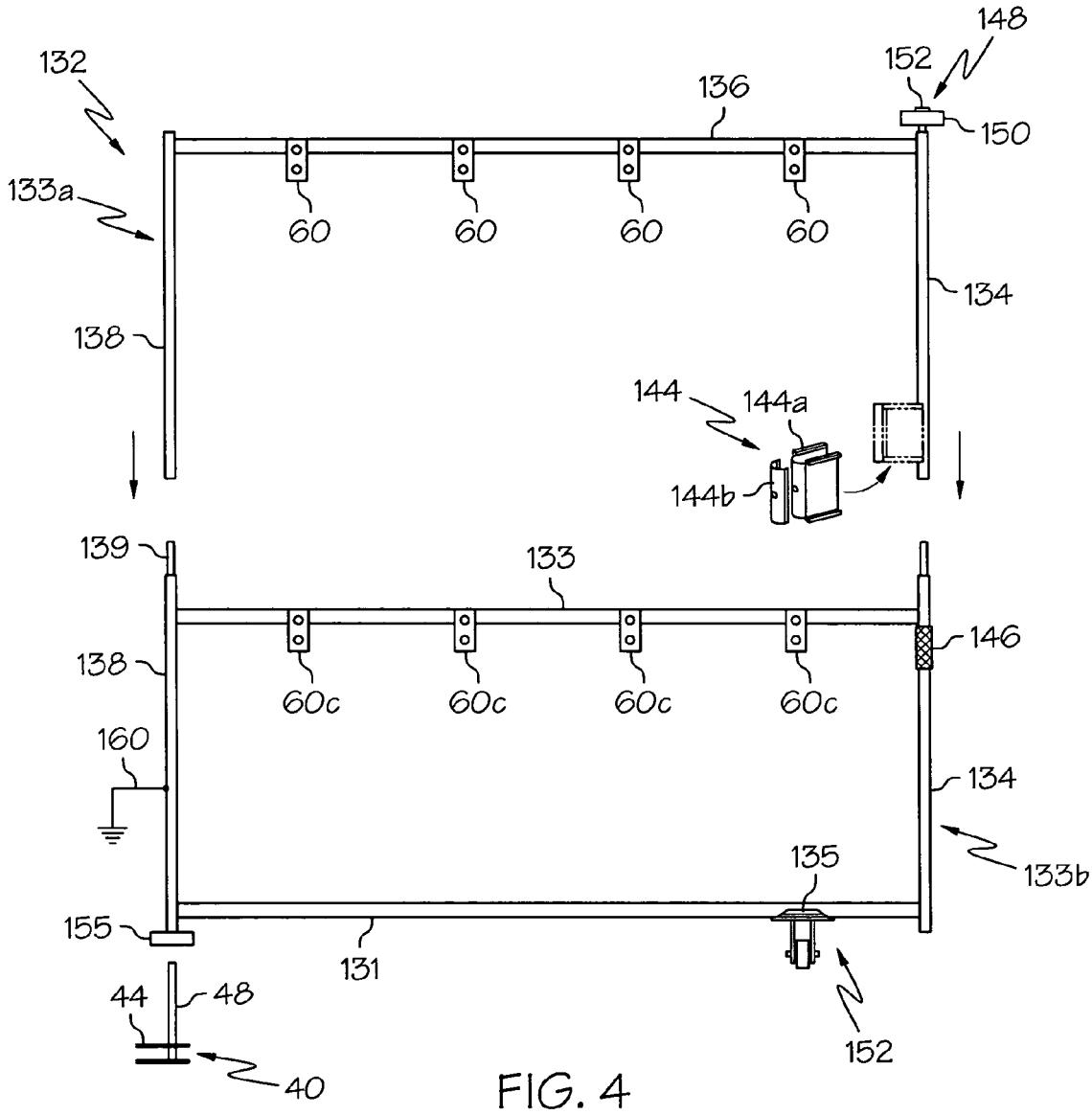
FIG. 4 is a front elevational view of an alternative embodiment of a frame of the present invention.

Referring to FIG. 4, an alternate embodiment of the frame 132 of FIG. 1 is shown and illustrated. In this example, the frame 132 is generally rectangular in overall shape, and comprises a front section 134, a top section 136, a rear section 138, a bottom section 131, as well as a crossbar 133. As previously stated, the frame 132 can be provided in a unified structure comprising various pieces of steel tubing and steel posts welded or otherwise secured together. In one embodiment, the front section 134 and rear section 138 might be provided in the form of powder coated steel tubing (e.g., 18 gauge), while the top section 136, bottom section 131 and crossbar 133 might be comprised of slightly lighter (e.g., 11 gauge) powder coated steel post. It might be desired to provide the front and/or rear sections as round tubes, while the other members might be more rectangular in shape to maximize their effective thickness profile. In other embodiments, the front section 134, top section 136, rear section 138, bottom section 131 and crossbar 133 may be comprised of any combination of posts and/or tubing constructed from any combination of steel, plastic, composite, aluminum and/or any other appropriately strong and durable substance.

In addition, where larger frames 132 are desired (i.e. the vendor desires display of large, heavy rugs) and the weight of the frames increases, it is contemplated that the frames 132 may be provided in the form of two or more pieces for convenient shipping and assembly. For example, in FIG. 4, the exemplary frame 132 may comprise an upper section 133*a* and a lower section 133*b* configured to be telescopically secured to one another in assembled condition. More particularly, swedged tubes 139 with diameters less than the diameters of the rear section 138 and the front section 134 of the frame 132 may be fitted within the rear section 138 and the front section 134 of the lower section 133*b* and/or welded thereto. The swedged tubes 139 may extend from the rear section 138 and the front section 134 of the lower section 133*b* any distance necessary for stabilized mounting of the upper section 133*a* thereto. The rear section 138 and the front section 134 of the upper section 133*a*, having a diameter greater than the diameter of the swedged tubes 139 can be removably secured to the swedged tubes 139. In another embodiment, the swedged tubes 139 may be fitted within the rear section 138 and the front section 134 of the upper section 133*a* and/or welded thereto. Such a frame 132 can be easily assembled by placing the base 40 on a display surface, mounting the lower section 133*b* to the post 48 of the base, and then mounting the upper section 133*a* of the frame 132 to the swedged tubes 139 of the lower section 133*a* of the frame 132.

Still referring to FIG. 4, the front section 134 of the exemplary frame 132 includes a display sleeve 144 selectively mounted to the frame 132 such as be screw or fastener attachment. The display sleeve 144 is configured to hold brochures, sales information and other advertising material relating to a particular rug or numerous rugs displayed. The display sleeve 144 can be made of any sturdy material such as plastic or steel, and one or more sleeves 144 can be mounted at any location along the front section 134 of the frame 132. As illustrated in FIG. 4, the display sleeve 144 may be comprised of a U-shaped sleeve 144*a* that may slide onto the front section 134 of the frame 132. The display sleeve 144 may be secured to the front section by placing a sleeve cap 144*b* on the end of the U-shaped sleeve 144*a* and inserting a bolt (not shown) through holes in the cap 144*b*, the U-shaped sleeve 144*a* and front section 134 of the frame 132, and then screwing a nut (not shown) to the end of the bolt. The display sleeve 144 itself might include a pocket for receiving an information card, advertisement or the like. It is contemplated that such a display sleeve 144 might be formed to include peripheral gutters or tabs to hold information cards in place while allowing substantial visual access and easy changeout of the cards by store workers. Of course, the display sleeve 144 may comprise a variety of shapes and sizes.

In one embodiment, the display sleeve 144 may be interchangeable with a variety of other display sleeves 144 including, but not limited to double-sided display sleeves 144 which effectively wrap around front section 134 so as to allow different literature (if desired) to be placed on the front side or backside of the display frame. The display sleeve 144 provides the vendor an alternative to pinning or otherwise attaching pertinent advertising information directly to the rugs.

The front section 134 of the exemplary frame 132 may also include one or more grips or handles 146 for customers to grab in order to pivot the frame 132 from one position to another. The grip 146 can be positioned at any location along the front section 134 of the frame 132 and can be made of a variety of materials including, but not limited to, plastic, rubber, foam, etc. Such grip 146 can also provide a visual cue to customers as to the most efficient place to manipulate the frame in use.

The front section 134 of the exemplary frame 132 may also include a bumper 148. In one exemplary embodiment, the bumper comprises a bumper wheel or roller 150 rotatably secured adjacent to the front section 134 of the frame 132, such as by a fastener 152. In use, an example bumper 148 might comprise a wheel 150 about 3" in diameter and constructed of rubber. The fastener 152 may be a pin, a screw or any other conventional fastening device which allows free rotation of the bumper wheel in use. In another embodiment, the bumper 148 might comprise a piece of plastic, rubber or any other conventional friction-minimizing interface mounted adjacent to the top of the frame 132. In use, the diameter of a rotating bumper 148 should normally be greater than the width of the members or tubes making up the front section 134, top section 136, rear section 138, bottom section 131 and crossbar 133 to minimize interference of two frames during rotational display.

The provision of a bumper or similar arrangement serves multiple functions. First, such a bumper (e.g., 148) can prevent the components of adjacent frames (e.g. clips 60) from interfering contact with one another as adjacent frames are rotated on a base in use. For example, in one embodiment, when at least two adjacent frames 132 are simultaneously moved, the individual frames would normally contact one another. In such a case, it will be understood that respective bumpers of adjacent frames will contact one another and prevent other components (such as the hanger clips) of adjacent frames from contacting and/or interfering with one another. Of course, where the hanger clips are flush with the frame (e.g. see, FIGS. 12 and 13 discussed below), the bumper 148 may not be needed because the hanger clips would not interfere with one another in normal and proper operation.

In addition, if the bumper is a wheel or other effectively low friction arrangement, as respective bumpers 148 come into contact, they rotate or otherwise help smoothly guide both frames past one another throughout their pivot. In another embodiment, a plurality of bumper wheels 150 may be disposed in the top section 136 of each frame 132 to smoothly guide a plurality of frames 132 throughout their pivot. Any bumper or spacing arrangement to ensure that adjacent frames do not catch or "hang up" on one another during rotation could be utilized.

As illustrated in FIG. 3, the rear section 138 of the exemplary frame 32 is illustrated as being pivotally mounted to a post 48 extending upwardly from the base 40. As previously described, the rear section 138 can be provided with a hollow lower portion having an inner diameter corresponding with, but slightly larger than the outer diameter of the post 48 so that the rear section can be rotatably mounted to the post 48 of the base 40. Furthermore, the rear section 138 may include a rotation bushing or protector 155 adjacent the bottom of section 138 which might slide over the post 48 of the base 40 and rest on the upper base plate 44 of the base 40. Protector 155 can be used to conceal the point of rotation between the rear section 138 of the frame 132 and the posts 48 of the base 40 to protect against pinching of the fingers, rug snags, etc. This protector 155 might also add strength to the lower portions of rear section 138 and/or serve as a wear bushing to the area of rotation of frame 132 on a post 48 of the base 40. In one embodiment, the protector 155 may comprise a generally flat washer welded to the bottom of the rear section 138. In another embodiment, this protector or bushing arrangement may include a bearing to aid the rear section 138 of the frame 132 in rotation about the post 48 of the base 40.

A ground wire 160 may be used to positively connect the rear section 138 of the frame 132 to provide an electrical ground arrangement so as to reduce the potential build-up of static electricity as the frame 132 pivots on base 40 and front support member 152 movably slides across the display surface. Generally, if steel tubing is utilized for the frame, base posts and base, such a ground wire may be superfluous.

One or more crossbars 133 may be mounted to the frame 32 depending on the number and size of rugs that a vendor wishes to display. The crossbar 133 can serve multiple functions. First, the crossbar may provide additional support for the frame and for rugs extending the length of the frame 132. For example, if a customer pivots the frame of FIG. 3 quickly to the left, a rug extending the length of the frame 132 may tend to swing through and out the back of the frame 132 if a crossbar 133 is not present. In addition, as illustrated in FIG. 4, the crossbar 133 may include a plurality of crossbar clips 60*c* for mounting additional rugs. For example, a first rug may be mounted to the top section 136 of the frame 132 and extend down toward the crossbar 133 and a second rug may be mounted to the crossbar 133 and extend down toward the bottom section 131. Therefore, it is envisioned that the rug display system of the present invention is capable of displaying one or more rugs of a variety of shapes and sizes.

Figure 5:
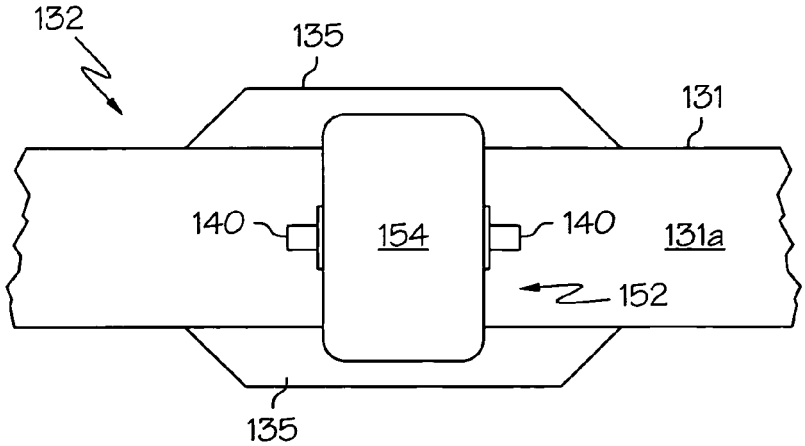
FIG. 5 is a partial bottom plan view of an exemplary front support member and front support member bumper of the present invention.

The bottom section 131 of the exemplary frame 132 may include a front support member 152 mounted thereto. It is understood that multiple support members 152 can also be utilized with a frame of the present invention. As seen in FIG. 5, the support member 152 might comprise a support member roller or wheel 154 and an axle 140. This assembly could be provided on a relatively standard caster arrangement commonly available in the industry. In another embodiment, a support member 152 may include a roller ball arrangement extending from the bottom of the front section 134 or bottom section 131 and configured to moveably support the frame 132 on a display surface (e.g., floor). In still another embodiment, the support member 152 may include a plastic (e.g., Teflon) or fiberglass body or other such friction minimizing interface affixed to the bottom of the front section 134 or bottom section 131 and configured to moveably support the frame 132 on a display surface. As an example, the front support member wheel 154 might be constructed of hard polyolefin in order to withstand wear from rigid surfaces. The support member 152 may be constructed from any material suited for support of the weight of the frame and displayed rugs and smooth rotation about a display surface. If more than one support member is used, they can be spaced along the bottom of a frame as desired to appropriately movably support the weight of the frame and any attached rugs or the like on the display surface.

As best seen in FIG. 5, the front support member 152 may similarly include a deflector cover or guard 135 located adjacent the bottom of frame 132. Such a cover could be located near the bottom of the front section (e.g., 134), near the front of the bottom section (e.g., 131) or along the underside 131*a* of the bottom section 131 of frame 132, and might advantageously effectively surround at least a portion of the front support member 152 as illustrated in FIG. 5. The deflector 135 serves a similar purpose as the bumper discussed above in that it can help minimize interference between adjacent frames during rotation. However, where a wheel, roller, caster or the like is utilized in the front support member (e.g., 152), deflector 135 may also be configured and located so as to ensure that such support member is substantially free of obstructions which might prevent its free rotation or pivoting. As can be understood, interference with movement, rotation or direction change of such front support member 152 could encumber the movement of a frame and/or make pivoting of the frame by a user less convenient and more difficult.

Figure 6:
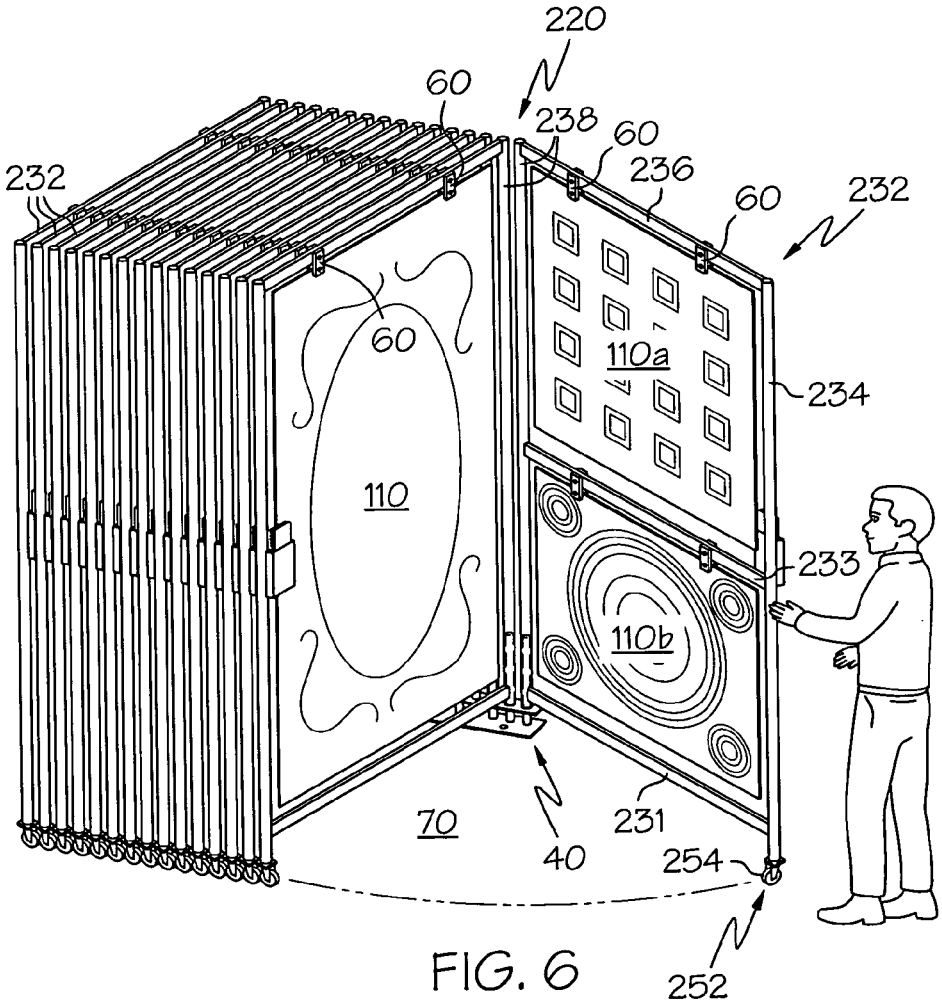
FIG. 6 is a perspective view of an exemplary rug display system made in accordance with the present invention.

Referring to FIG. 6, an exemplary rug display system 220 for displaying a variety of rugs on a display surface is shown and illustrated in use. The rug display system 220 of FIG. 1 is illustrated as comprising a plurality of frames 232 mounted to a base 40. In addition, each one of the plurality of frames 232 includes a front support member 252 to moveably support each one of the plurality of frames 232 on a display surface 70 such as a showroom floor. As the plurality of frames 232 are supported on the display surface 70 by the base 40 and by the front support member 252, it will be understood that a great degree of stability is achieved by the rug display system 220 of the present invention. Particularly, the weight of each frame 232 and rugs 110 carried by that frame is supported by the base 40 and front support member 252 on the display floor. In contrast to swing arm and other previously available display systems which had significant weight and structure located high above the floor, the combination of the frame with its support base (e.g. 40) and appropriate front support member (e.g. 252) of the present invention allow for the weight of the system and its displayed products to be kept low and supported directly on the display surface.

As mentioned, the rugs 110 displayed by the rug display system 220 can be of various sizes and shapes, and are secured to the frames 232 by a plurality of rug clips 60. For example, in FIG. 6, two rugs 110*a* and 110*b* are shown as being secured to a single frame 232. A first rug 110*a* is mounted to the top section 236 of the frame 232 and extends toward the crossbar section 233. A second rug 110*b* is mounted to the crossbar section 233 and extends to the bottom section 231 of the frame 232.

A customer may view the rug(s) 110 on each frame 232 by pushing or pulling on the front section 234 of each frame 232, thereby pivoting a frame 232 on base 40 so that the customer can easily move from sample to sample without having to pull on the displayed rugs themselves. As envisioned herein, the frames 232 of the present invention are capable of rotating up to about 180° relative to the base 40 in an open-book arrangement to provide a customer with a full view of rugs displayed by the rug display system 220. In this way, the display assembly of the present invention uniquely maximizes rug viewing area for the allotted display area of the showroom.

Figure 8:
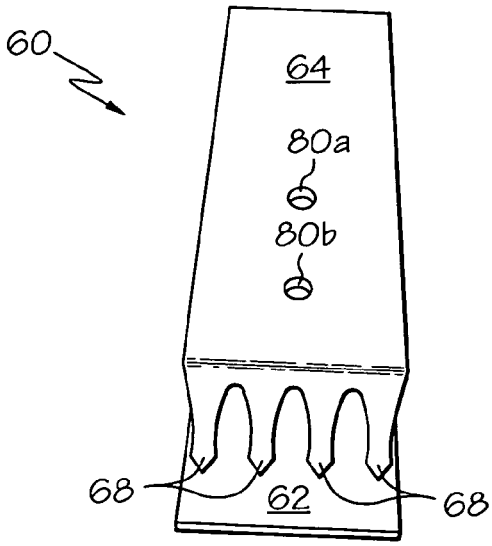
FIG. 8 is a rear side perspective view of the rug clip of FIG. 7.
Figure 7:
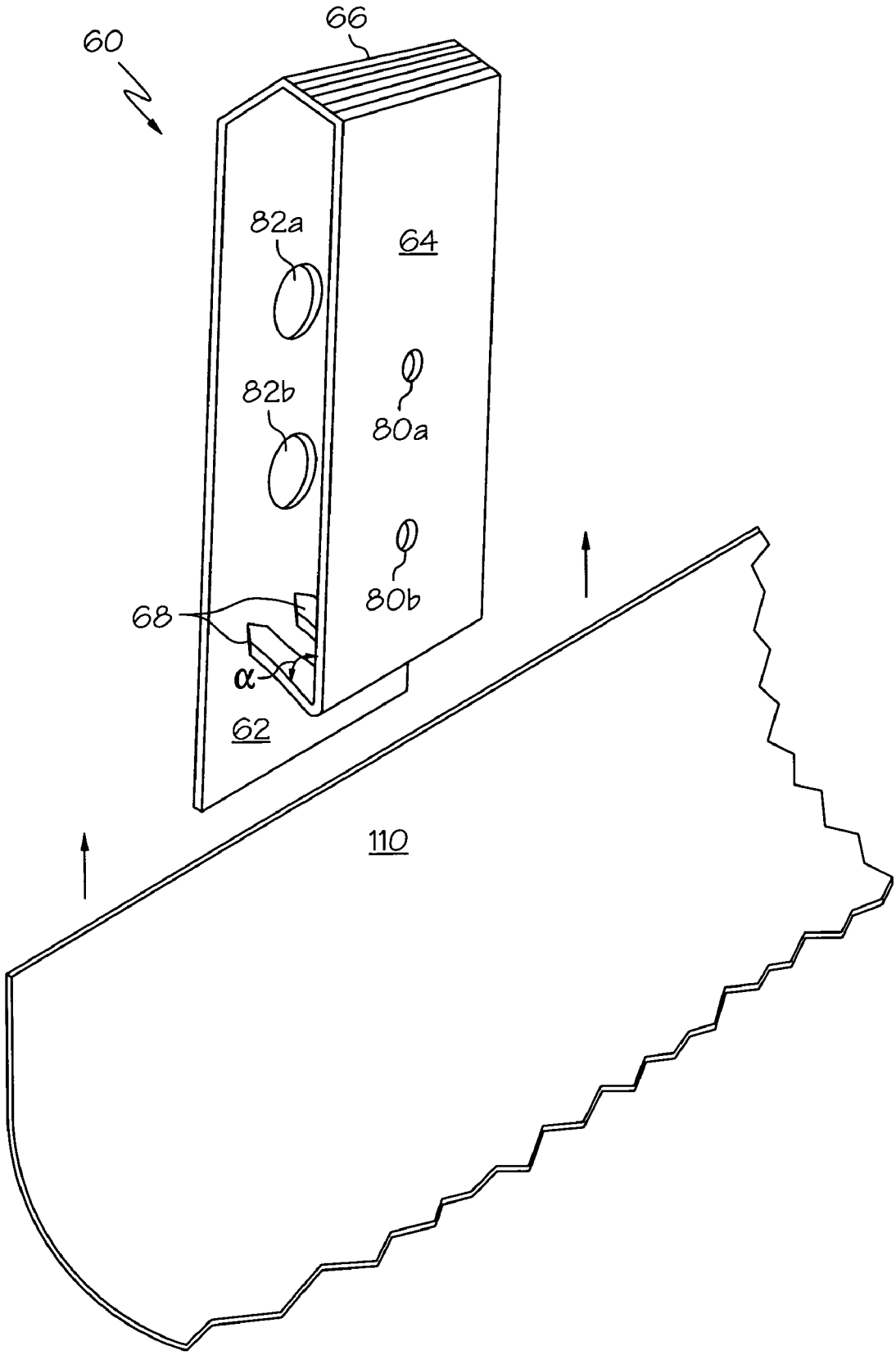
FIG. 7 is a rear bottom perspective view of an exemplary rug clip for use in a rug display system in accordance with the present invention.

Referring to FIGS. 7–8 (and 12–13), examples of individual rug clips 60 (and 160) which might be used in the rug display system 20 are shown and illustrated. As illustrated in FIGS. 7–8, in one embodiment, the clip 60 might be provided as a single piece of spring steel having a normally closed bias designed in. In such embodiment, the rug clip 60 may be formed by bending a single piece of spring steel into the general shape of the clip, heat treating the clip and then post-hitting the clip with appropriate compression force in order to preload (create bias). It is understood however, that the rug clip 60 may be constructed from more than one piece of material (e.g., steel) welded or otherwise secured together to form a clip mechanism for securing a rug (e.g. FIG. 12).

In FIG. 7, an exemplary rug clip 60 is illustrated as comprising a channel shaped bracket including a top leg 62, a bottom leg 64 and a connecting member 66. The connecting member 66 can be configured and bent so as to bias the top leg 62 toward the bottom leg 64 in order to securely hold a rug. In addition, the bottom portion of the bottom leg 64 may include a plurality of teeth 68 for gripping a rug when the rug is inserted into the rug clip 60. Referring briefly to FIG. 8, a rear perspective view of the rug clip 60 illustrates a plurality of upwardly angled teeth 68. As best seen in FIG. 8, the bottom portion of the bottom leg 64 comprises four spaced teeth 68 in this example. However, it is understood that the bottom leg 64 of the rug clip 60 could alternatively comprise any number of teeth, serrations or other gripping elements 68 as required to mount and hold a rug to a frame. In the exemplary embodiments of FIGS. 7–8, the plurality of teeth 68 are biased against the inside surface of top leg 62 and form an acute angle a with the bottom leg 64.

Referring again to FIG. 7, bottom leg 64 of the rug clip 60 may include two bottom leg apertures 80*a* and 80*b* configured to accept fasteners (e.g., bolts or screws) for mounting the rug clip 60 to a frame. Additionally, the top leg 62 may include one or more access apertures to facilitate placement and manipulation of the fasteners. In one embodiment, the apertures 82*a* and 82*b* would be larger in diameter than the apertures 80*a* and 80*b* so that the fasteners that connect the bottom leg 64 of the rug clip 60 to a frame may be accessed for tightening and/or loosening by a standard tool such as a screwdriver, socket or driver. In another embodiment, the apertures in the bottom leg 64 may be larger than those in the top leg 62 so that the rug clip 60 can be mounted to a frame in reverse, orientation (i.e., with the gripping teeth or serrations directed inwardly).

In one embodiment, the rug clip 60 is mounted to the frame by placing the bottom leg 64 of the rug clip 60 against a frame and aligning the bottom leg apertures 80*a* and 80*b* with predrilled holes in the frame. Once aligned, a fastener may be inserted through the upper top leg aperture 82*a* to the upper bottom leg aperture 80*a* which is aligned with the predrilled aperture. Depending on the type of fastener, a screwdriver, socket or fastener driver may be inserted through the upper top leg aperture 82*a* to contact the fastener. The fastener is then tightened into place to secure the rug clip 60 to the frame. These steps may be repeated for the lower bottom and top leg aperture 80*b* and 82*b*. It is understood, however, that the rug clip 60 can be mounted to the frame in a variety of ways including, but not limited to, a weld or providing a frame configured so that the clips 60 may be removably secured to it. Removal and replacement may be desired to modify the location of clips and/or to replace damaged or broken clips.

Figure 12:
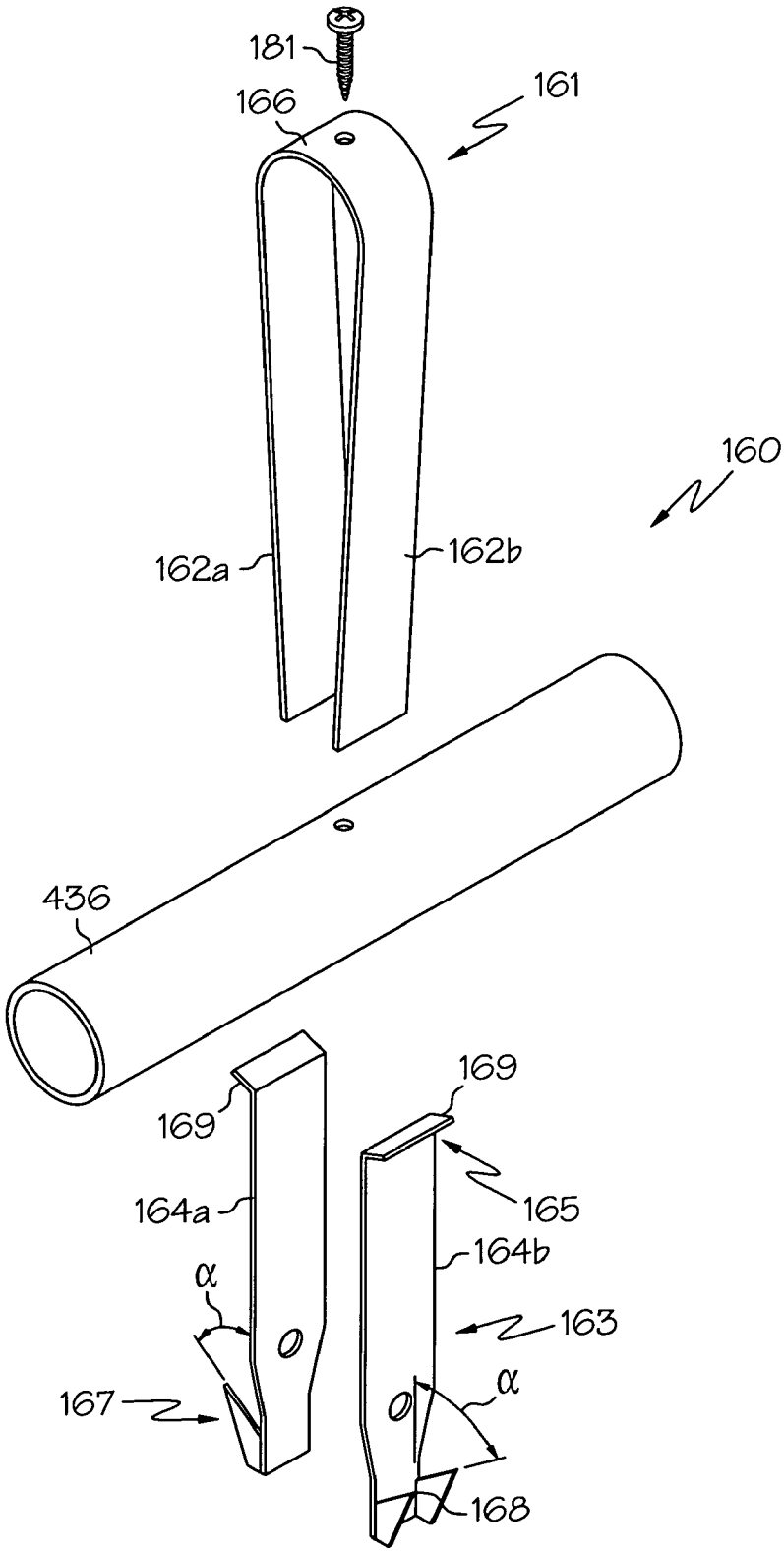
FIG. 12 is an exploded view of an alternative embodiment of a rug clip made in accordance with the present invention.
Figure 13:
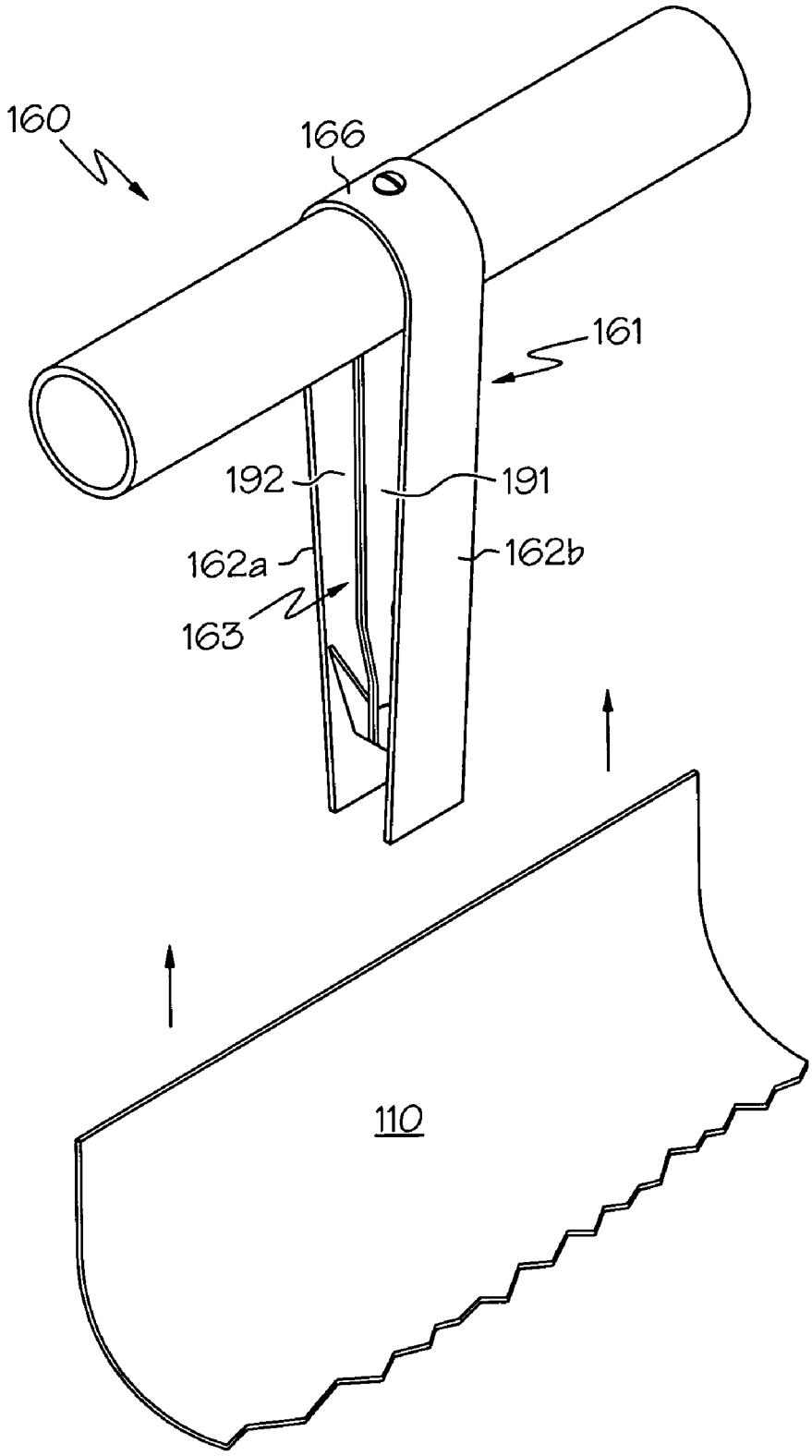
FIG. 13 is a perspective view of the rug clip of FIG. 12.

In an alternative embodiment, such as that illustrated in FIGS. 12 and 13, rug clip 160 may comprise a gripping member or center portion 163 and a biasing member 161. Biasing member 161 is shown as having a first top leg 162*a* and second top leg 162*b* and a connecting member 166. The biasing member 161 may be comprised of spring steel or other at least effectively flexible material which can be configured to provide an inward bias, as will be explained. As illustrated, a single piece biasing member 161 might be bent to form a central connecting member 166 having the downwardly extending first and second top legs. Such configuration might provide a natural bias of the first and second top legs 162*a* and 162*b* toward the gripping member 163 in order to securely hold a rug. In another embodiment, biasing member may be comprised of a number of individual compartments.

While biasing member 161 is illustrated as having a substantially rounded connecting member 166 (to correspond with a rounded frame section 436) associated with each top leg, that need not be the case. Biasing member could likewise be configured to correspond with any variety of frame conformation (e.g., square, rectangular, angular or otherwise), or it might not necessarily match the frame shape. Here, a rounded configuration is illustrated as possibly advantageous to simplify the bending process and preloading of biasing force, and to match the exemplary rounded frame shape.

In one embodiment, gripping member or center portion 163 may comprise two bottom legs 164*a* and 164*b*. This gripping member might be formed of a single integral piece of material, or might be provided as several pieces secured together with, for example, a spot weld (see, e.g. FIG. 12). As illustrated, gripping member 163 may further comprise proximal end 165 and distal end 167, respectively, wherein proximal end 165 may include one or more flanges or appendages 169 for mounting the gripping member 163 to the top section 436 of frame such as by, for example, a weld, rivets or other fasteners. Distal end 167 of gripping member 163 may include a plurality of teeth 168 or other gripping element(s) for gripping a rug when the rug is inserted into the rug clip 160. Similar to FIGS. 7–8, the plurality of teeth 168 are pushed or pinched against the inside surface of top legs 162*a* and 162*b* as a result of the inward bias of the biasing member 161, and tend to form an acute angle $\alpha$ with the gripping member 163.

In one embodiment, the rug clip 160 is mounted to the frame by securing gripping member 163 in an advantageous location on a section of the frame (e.g. top section 436 as illustrated in FIGS. 12 and 13). Biasing member 161 may then be positioned downward around top section 436 so that top legs 162*a* and 162*b* generally are biased toward teeth 168 of gripping member 163. Biasing member may thereafter be secured to the frame by, for example, a fastener 181 or weld. As an example, after biasing member 161 is placed over the frame section (e.g., 436) and in proper biasing orientation relative to the gripping member 163, a metal screw or rivet (e.g., 181) might be placed through member 161 and into the frame section to keep biasing member 161 from moving along the frame or otherwise being knocked loose. It is also contemplated that rug clip 160 may be removeably secured to frame such a by providing a bracket or groove (not shown) associated with the frame (e.g., on the underside of frame section 436) for selectively securing the gripping member thereto. For example, a groove or keyway might be formed along the lower parts of various frame sections (e.g., sections 133, 136, 236, 436) to allow for insertion of a corresponding key or flange 165 of a gripping member 163. In this way, clips could be easily added, removed, or moved as needed for any particular rug display frame, or to accommodate a custom size or shape of rug.

As will be appreciated, one advantage of a clip such as illustrated in FIGS. 12 and 13 is that it can easily accommodate back to back rugs for simultaneous display, yet can function well if only a single rug is inserted. For example, one rug could be inserted into clip 160 by pulling an upper edge of the rug 110 upwardly past distal end 167 and into the area 191 between gripping member 163 and the inside surface of top leg 162*b* (FIG. 13). The inward bias of top leg 162*b* would tend to push the rug against gripping member 163, and teeth 168 would prevent the rug from easily moving downwardly. A second rug (not shown) could be similarly inserted on the other side of the clip 160, with the upper edge of such rug being drawn into space 192 between gripping member 163 and the inner surface of top leg 162*a*. Because of the effective double inward bias of biasing member 161 and the double faced gripping member 163, clip 160 works equally well with rugs on either side, or both sides. As will be understood, this unique clip arrangement thereby obviates a need for having individual clips for particular display "faces" or sides of a display rack.

As previously stated, the rug clips 60 and 160 of the present invention can be mounted at any location on a frame including, but not limited to the front section, the top section, the rear section, the bottom section and the crossbar. In FIGS. 6 and 12, once the exemplary rug clips 60 and 160 are mounted to a frame, a rug 110 can be secured in the rug clips 60 and 160 by placing the edge of a rug 110 up against the teeth 68 of the rug clip 60 and then pushing the rug 110 toward the connecting member 66 and 166. As mentioned, two rugs may be mounted (e.g., back to back) from the clip 160 illustrated in FIG. 12. As the teeth 68 and 168 of the bottom portion of the bottom leg 64 and center portion 163 are oriented upwardly and toward the top legs 62 and 162*a* and 162*b*, the rug 110 may freely slide upward without damaging the rug 110. Furthermore, once in place, the upward angle or orientation of the teeth 68 and 168 prevents the rug from slipping to the floor as the teeth of the clips 60 and 160 grab the back of the rug. The bias of the clips 60 and 160 tend to hold the gripping elements (e.g., teeth, serrations, or knurled surface) against the nap of the rug. Gravity also tends to engage the gripping elements with the rug to secure it in place.

The rug may be dismounted and removed from such clips by pulling the rug outwardly (i.e., away from bottom leg 64 or gripping member 163) toward the top legs 62 and 162*a* and 162*b*. The outward force tends to pull the top legs 62 and 162*a* and 162*b* away from the teeth 68 and 168, thereby releasing the rug from the gripping elements. The rug can then be slid out of a clip without interference. Accordingly, a single clerk can conveniently secure a rug 110 to, or remove a rug 110 from a frame in the rug display system. Moreover, no independent opening or unclamping of individual rug clips is required, as upward pulling of a rug away from bottom leg results in an automatic release from the clip.

Another feature of the present invention is that the frames of the rug display system may be easily removed from the base for changing the display and/or placing or removing a rug. The frame may be removed from the base by lifting the frame upwardly off of the post of the base. Removability of the frames serves a number of functions including efficient assembly and disassembly. For example, a clerk may remove a frame from the rug display system in order to secure a rug to, or remove a rug from the frame. While it is not required that the frame be removed from the base in order to secure a rug to, or remove a rug from the frame, removal of the frame may be desired when a single clerk needs to secure or remove a heavy rug. In this way, it can be understood that a frame could be placed on the floor for placing a rug on the frame, then the frame and rug can be stood up and the frame inserted onto a support post on a base 40.

Figure 9:
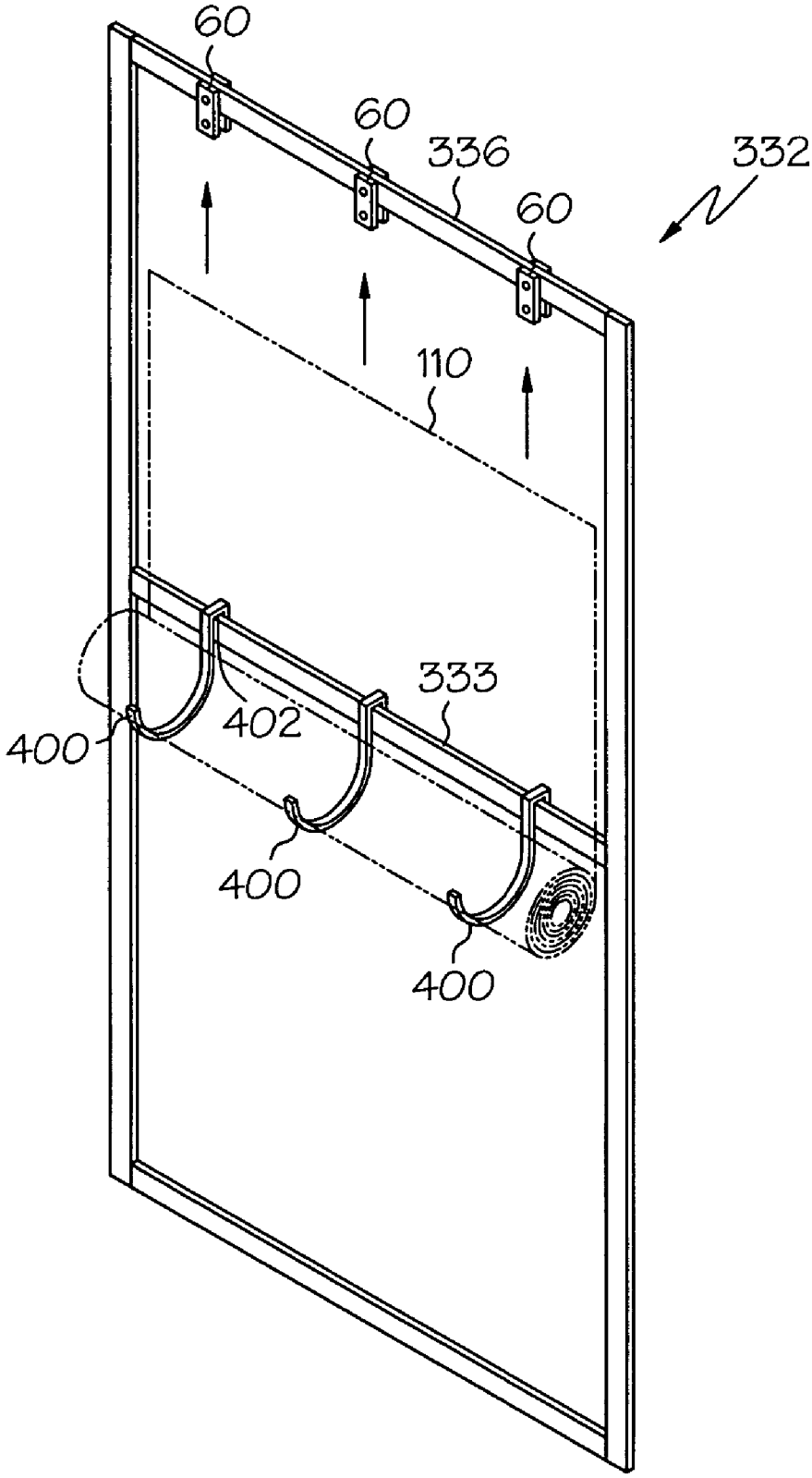
FIG. 9 is a front perspective view of an exemplary frame according to the present invention illustrating a plurality of rug hangers positioned on the frame for facilitating hanging a rug thereon.

As illustrated in FIG. 9, in situations where removal of a frame for mounting a rug thereto is inconvenient or otherwise less desirable, a plurality of rolled rug hangers 400 may be provided for supporting a rolled-up rug 110 adjacent the crossbar section 333 of a frame. The rug hangers 400 may have a general shape reminiscent to the number "5" and can be made of flat steel. However, it should be understood that the rug hangers may comprise a variety of shapes and can be made of plastic, composite, aluminum and/or any other appropriately strong and durable substance. In addition, while FIG. 9 illustrated the rug hangers positioned on the crossbar 333 of the frame 332, it is understood that the rug hangers may be positioned anywhere on the frame including, but not limited to the top section 336 of the frame 332.

In use, the rug hangers 400 may be positioned on the crossbar 333 by pushing the channel 402 of the rug hanger 400 downward over the upper portions of crossbar 333. In FIG. 9, three rug hangers 400 are provided with the first rug hanger 400 positioned at about the center of the crossbar 333 and the remaining two rug hangers 400 positioned adjacent opposite sides of the frame. However, any number of rug hangers 400 may be positioned at any location along the crossbar 333.

A rolled-up rug to be hung is then positioned in the rug hangers 400, and thereafter a single clerk may maneuver the upper edge of the rug 110 into the rug clips 60 as described above. Once the edge of the rug is inserted into the rug clips, the clerk may then remove the remainder of the rolled-up rug 110 from the rug hangers 400 and allow the rug 110 to drape downwardly over the hangers 400 and toward the display surface. The clerk may them remove the rug hangers 400 from the rear of the rug by pulling the rug hanger 400 upward and off of the crossbar 333 and twisting the rug hanger 400 sideways to slide them past crossbar 333.

Figure 10:
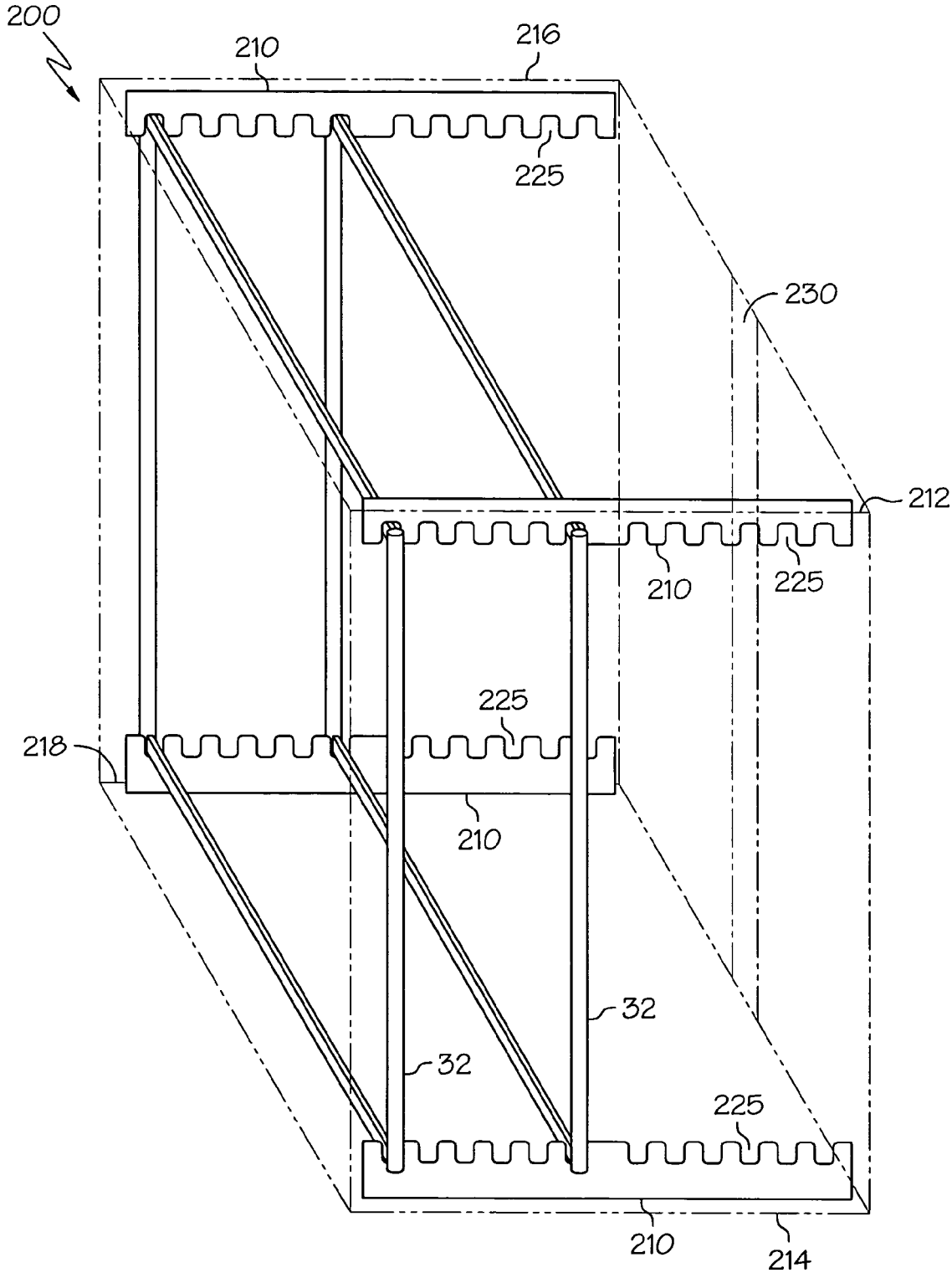
FIG. 10 is a perspective view of an exemplary packaging system for shipping a plurality of rug display system frames in accordance with the present invention.

Yet another aspect of the present invention is that the rug display systems may also be shipped partially assembled or disassembled. FIGS. 10–11, illustrate exemplary packaging systems for the rug display system of the present invention. Referring to FIG. 10, a packaging system for a disassembled rug display system is shown and illustrated. The system may comprise a relatively standard shipping crate 200 generally in the shape of a box. The crate (e.g., 200) may be sized larger or smaller according to the size of the frames intended to be shipped. The crate 200 is also illustrated as including a plurality of cradles 210 positioned adjacent to the upper proximate horizontal edge 212, the lower proximate horizontal edge 214, the upper distal horizontal edge 216 and the lower distal horizontal edge 218. In another embodiment, the frame cradles 210 can be positioned along the proximate and distal vertical edges of the crate 200. The same result can be achieved by rotating the crate 200 about the X-axis 180°. In another embodiment, the crate 200 may include frame cradles 210 adjacent to either the upper and lower proximate horizontal edges 212, 214 or along the upper and lower distal horizontal edges. In one embodiment, each cradle 210 includes a plurality of spaced recesses 225 for receiving a plurality of frames 32. The recesses 225 prevent the frames from contacting one another and maintain a predetermined orientation and spacing of the frames during shipment. If desired, the recesses 225 may include padding for further securing the frames during shipment.

In one embodiment, the recesses 225 of the corresponding frame cradles 210 can be vertically aligned to accept and secure the frames 32. For example, the recesses 225 of the frame cradles 210 positioned on the upper proximate and distal horizontal edges 212 and 216 are vertically aligned with the recesses 225 of the frame cradles 210 on the lower proximate and distal horizontal edges 214 and 218. Moreover, the recesses 225 of the frame cradles 210 positioned on the upper and lower proximate horizontal edges 212 and 214 can be horizontally aligned with the recesses 225 of the frame cradles 210 on the upper and lower distal horizontal edge 216 and 218.

In one embodiment, the crate 200 may include one or more crossbar support member 230 positioned against a wall inside the crate. The crossbar support member 230 can be made of wood, steel or any other durable material. The crossbar support member 230 adds structural support to the crate and can also provide additional lateral support to a plurality of frames within the crate.

Therefore, in accordance with the packaging system for shipping rug display system frames 32 of the present invention, frames 32 may be inserted into the crate 200 by working the frame between a first set of corresponding recesses 225, pushing the frame 32 through the crate 200, and working the frame through a second set of corresponding recesses 225. Boxes of clips and other accessories may then be placed within the inserted frames and taped, shrink-wrapped or banded in place within the crate.

The packaging system of the present invention serves multiple functions. First, as previously stated, the packaging system provides a means for shipping a plurality of rug display system frames while minimizing potential damage to the frames. In addition, the packaging system of the present invention provides for easy and efficient loading and unloading of the packaging system and its contents (e.g., rug display system frames) from a truck. For example, the crate of the packaging system may be packed in a warehouse with a plurality of rug display system frames and then loaded onto a truck using a standard forklift. Once the crate bearing the rug display system frames arrives at its destination, a single person may unload the crate by opening the crate and then removing the rug display system frames one at a time. In this way, cranes, lift trucks, loading docks or other specialized equipment is not necessary for a customer to receive a display system of the present invention for installation.

Figure 11A:
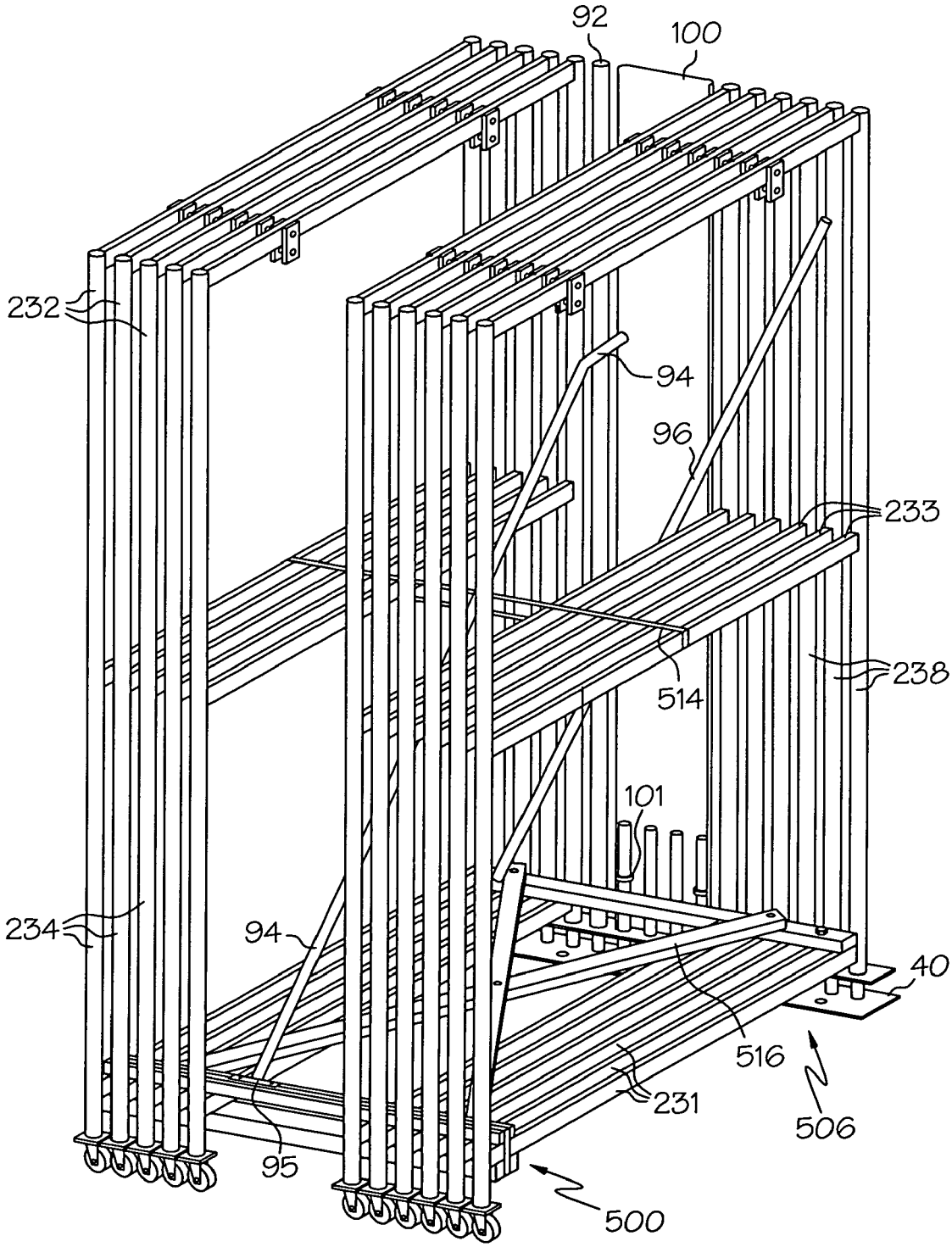
FIG. 11*a* is a partially broken out perspective view of an exemplary packaging system for shipping rug display systems in accordance with the present invention.
Figure 11B:
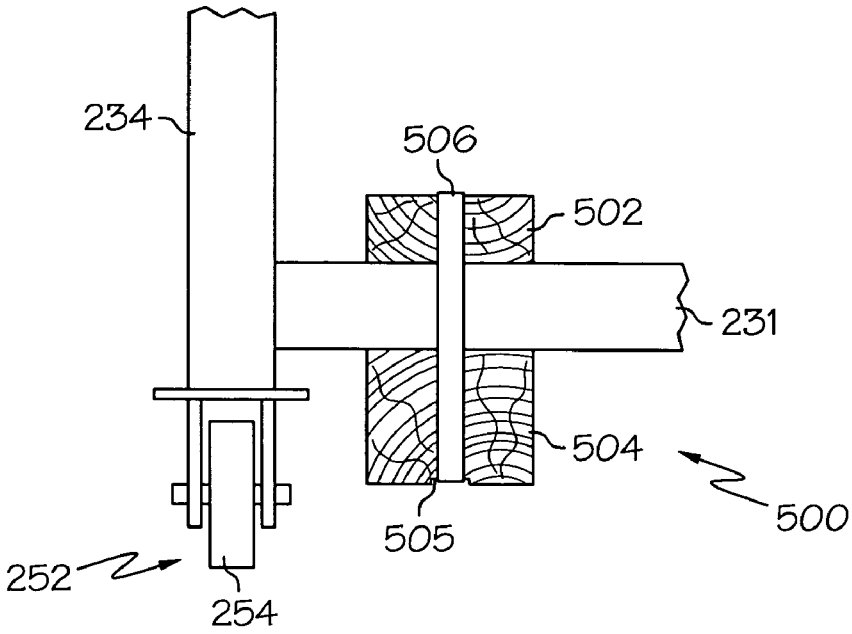
FIG. 11*b* is an exploded view of the front section assembly of the exemplary packaging system illustrated in FIG. 11*a;*
Figure 11C:
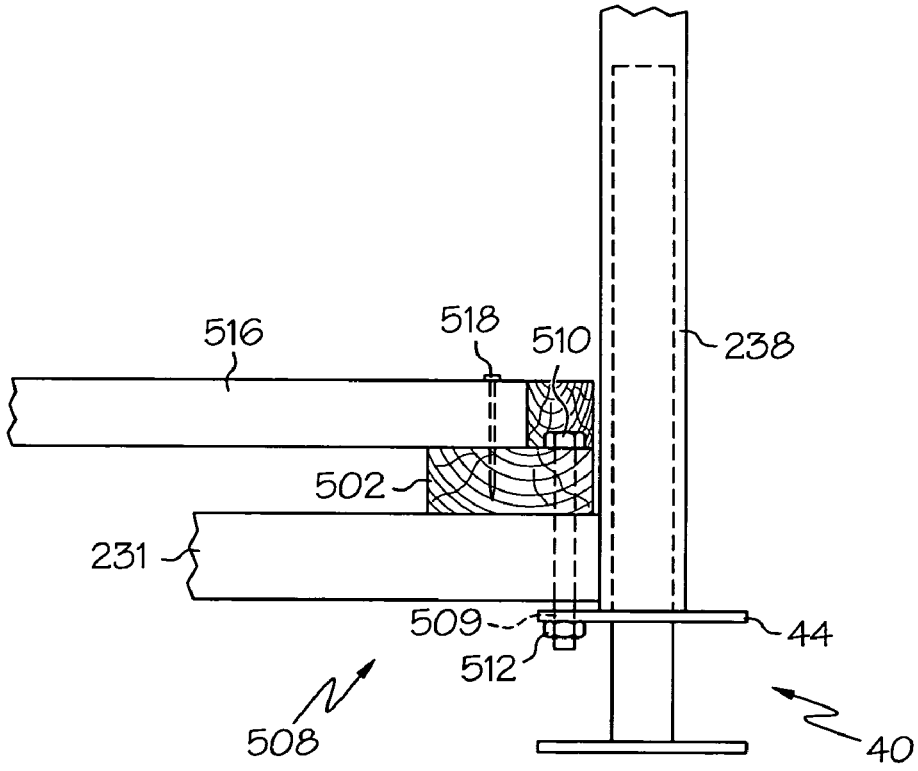
FIG. 11*c* is an exploded view of the rear section assembly of the exemplary packaging system illustrated in FIG. 11*a;*

Alternatively, it may be desired to have the rug display system of the present invention delivered in assembled or semi-assembled condition, thus saving multiple hours of installation time. Referring to FIGS. 11*a–c,* a packaging system for an assembled rug display system is shown and illustrated. The display system shown in FIGS. 11*a–c* is essentially the same system shown in FIG. 6. Generally, the packaging system comprises multiple bands and blocks used to secure the frames 232 and base 40 so that the rug display system may be transported as a unit onto a truck or into a store by use of a pallet jack or other lifting device. The exemplary packaging system of FIGS. 11*a–c* may secure the rug display system in multiple locations. First, the packaging system may include a front section assembly 500 (as also shown in the partial cross-section of FIG. 11*b*). The front section assembly includes a first securing member 502 positioned on top of the plurality of bottom sections 231 and adjacent the plurality of front sections 234 of the frames 232. In one embodiment, the first securing member 502 might comprise a 2"×4" piece of wood, but may include steel, pressboard, plastic composite or any other sufficiently sturdy material. The 2"×4" 502 extends substantially the entire length of the plurality of adjacent bottom sections 231. A second securing member 504 is then positioned on bottom of the plurality of adjacent bottom sections 231 and adjacent the plurality of front sections 234 of the frames 232. In one embodiment, the second securing member 504 comprises a 4"×4" piece of wood, but again may include steel, pressboard, plastic, composite or any other sufficiently sturdy material. The 4"×4" 504 may include a channel 505 on the posterior surface for receiving a metal securing band 506 therein. The channel prevents the metal band 506 from moving or contacting the surface should the member 504 extend downward beyond the wheel 254 of the front support member 252. The metal band 506 may be wrapped around the securing members 502 and 504 with at least a portion of the band positioned in the channel 506 and then tightened to secure the plurality of front sections 234 together. If desired, a second metal band 514 may be used to secure the plurality of crossbar sections 233 and/or other portions of the assembly "cube".

The rear section assembly 508 singularly includes a securing member 502 positioned on top of the plurality of adjacent bottom sections 231 and adjacent the plurality of rear sections 238 of the frames 232. In this illustration, the securing member 502 might comprise a 2"×4" piece of wood, but may include steel, pressboard, plastic, composite or any other sufficiently sturdy material. As best seen in FIG.

11*c*, a plurality of apertures (e.g., 509) can be drilled into the upper plate 44 of the base for accepting a bolt or other fastener 510. To prevent the base 40 from falling as the rug display system is lifted, a fastener 510 may be inserted into the member 502, in between two adjacent bottom sections 231 and through the upper plate aperture and then secured by a nut 512. The base 40 may be secured to the member 502 in more than one location as necessary to effectively captivate the base and keep it from falling when the rug display system is lifted.

To add support to the packaging system, an X-bracing 516 may be positioned from corner to corner on the two securing members 502 described above. The X-bracing 516 can be made of wood, steel or any other sufficiently sturdy material to help maintain the integrity and dimensional stability of the packaging system cube as it is shipped. In addition, the X-bracing 516 may be secured to a member 502 by a nail 518, screw or any other appropriate fastening device.

Rug display system accessories (described above) may also be conveniently secured in either of the packaging systems of FIGS. 10 and 11. For example, with respect to the example of FIGS. 11*a–c,* the divider 100 may be positioned on the posts of the base, just as it would be when the rug display system is in assembled condition for operation. FIG. 11 a illustrates the divider 100 mounted in the middle of the base 40 for convenient illustration of all accessories. If the rug display system is shipped as illustrated, a block (not shown) may be positioned between the gap in the front sections 234 to prevent the front sections 234 from swinging into one another. In another embodiment, the divider 100 may be mounted to the outermost posts of the base 40.

In addition, components of the accessory display assembly (FIG. 3) can be broken down and secured in the packaging systems of the present invention. For example, in the example of FIGS. 11*a–c,* the pole 92 for the display assembly may also be mounted to a base post. In addition, the extension arm 94 may be turned upside down and positioned within the perimeter of the frames 232 with the brackets 95 of the extension arm 94 being mounted to the member 502 by a nail, screw or any other appropriate fastening device, and with the other end (tubular portion) resting against the inner side of the plurality of frames 232. The mounting bar 96 can similarly be positioned diagonally within the perimeter of the frames 232 as well. As mentioned above, additional components such as the bumper, rug hangers, fasteners for the base, etc. may by packed in boxes and positioned on the plurality of bottom sections 231. Therefore, all components of the rug display system may be secured together and confined within the packaging cube generally defined by the perimeter of the plurality of frames 232.

The rug display system may be easily moved or transported by inserting the legs of a pallet jack or forklift under the bottom sections of the rug display system and lifting upward. If desired, a conventional pallet may also be placed under or secured to the bottom sections of the frames for additional support and guidance.

The packaging system of the present invention serves multiple functions. First, as previously stated, the packaging system of the present invention provides for easy and efficient loading and unloading of the rug display system from a truck. For example, the entire rug display system, including accessories and components can be lifted to a truck and subsequently to a store by one trip with a forklift, pallet jack or other lifting device. In addition, the packaging system allows an assembled rug display system to be delivered to the customer. Delivery of an assembled rug display system can save hours of time otherwise needed to properly assemble the system.

The foregoing description of the various embodiments of the invention has been presented for the purposes of illustration and description. It is not intended to be exhaustive or to limit the invention to the precise form disclosed. Many alternatives, modifications and variations will be apparent to those skilled in the art of the above teaching. For example, the rug display system in accordance with the present invention may display rugs of varying sizes and shapes in a variety of different arrangements and can include frames of various sizes and shapes. Accordingly, while some of the alternative embodiments of the rug display system have been discussed specifically, other embodiments will be apparent or relatively easily developed by those of ordinary skill in the art. Accordingly, this invention is intended to embrace all alternatives, modifications and variations that have been discussed herein, and others that fall within the spirit and broad scope of the claims.

What we claim is:

1. A rug clip for use in a rug display system comprising:

a gripping member having oppositely disposed gripping elements;

a biasing member having a first and second top leg; and said biasing member mounted over at least a portion of said gripping member such that one of said first and second top legs is each biased toward a different one of said oppositely disposed gripping elements, wherein said gripping elements comprise a plurality of teeth angled upwardly toward each of said top legs, each tooth having a top surface extending upwardly from said top leg and thereby forming an acute angle between said top surface and said gripping member, wherein said gripping member and said top leg are spaced such that a rug may be slid upwardly between said gripping member and top leg and wherein the teeth and force of the biasing member are configured to prevent the rug from slipping downward when the rug is in place and hanging downward from the rug clip.

2. The rug clip for use in a rug display system as in claim 1, wherein a distal end of said gripping member comprises said gripping elements.

3. The rug clip for use in a rug display system as in claim 1, wherein a proximal end of said gripping member comprises at least one attached flange.

4. The rug clip for use in a rug display system as in claim 1, wherein said gripping member comprises two bottom legs secured to one another.

5. The rug clip for use in a rug display system as in claim 1, wherein said biasing member is secured to a frame.

6. The rug clip for use in a rug display system as in claim 1, wherein said gripping member is secured to a frame.

7. The rug clip for use in a rug display system as in claim 1, wherein said biasing member further comprises a connecting member between said first and second top legs.

8. The rug clip for use in a rug display system as in claim 7, wherein said biasing member is provided as a single integral piece.

9. A rug display system comprising the rug clip of claim 1.

* * * * *